United States Patent [19]

Takami

[11] Patent Number: 4,938,009

[45] Date of Patent: Jul. 3, 1990

[54] AUTOMATIC PACKAGE STRAPPING MACHINE

[76] Inventor: Masaho Takami, 9-5, Kohrienyamanote-cho, Hirakata-shi, Osaka-fu, Japan

[21] Appl. No.: 176,172

[22] Filed: Mar. 31, 1988

[30] Foreign Application Priority Data

Apr. 25, 1987 [JP] Japan ..... 62-63062[U]
Sep. 4, 1987 [JP] Japan ..... 62-135919[U]

[51] Int. Cl.[5] ..... B65B 13/06; B65B 13/18

[52] U.S. Cl. ..... 53/589; 53/582; 100/26; 100/33 PB; 242/75.2

[58] Field of Search ..... 53/582, 589; 100/26, 100/33 PB; 242/75.2

[56] References Cited

U.S. PATENT DOCUMENTS

| | | | |
|---|---|---|---|
| 2,993,659 | 7/1961 | Johnson | 242/75.2 X |
| 3,057,289 | 10/1962 | Luthi | 100/26 |
| 3,647,128 | 3/1972 | Shah | 242/75.2 X |
| 3,672,595 | 6/1972 | Jablin | 242/75.2 |
| 4,030,678 | 6/1977 | Simpson | 242/75.2 X |
| 4,172,565 | 10/1979 | Zaffarano | 242/75.2 X |
| 4,177,724 | 12/1979 | Johnson | 100/26 |
| 4,534,817 | 8/1985 | O'Sullivan | 53/589 X |
| 4,559,767 | 12/1985 | Takami | 53/589 |
| 4,575,994 | 3/1986 | Takami | 53/582 |

*Primary Examiner*—John Sipos
*Attorney, Agent, or Firm*—Wenderoth, Lind & Ponack

[57] ABSTRACT

A package strapping machine draws a thermoplastic strap off of a reel, loops the strap around a package, clamps a leading end of the strap, and then tightens the strap around the package with a strap tightening mechanism. A trailing end of the strap is cut underneath the leading end, and then both these ends are automatically welded together. When the strap is tightened, a portion of the strap is fed back towards the reel. The reel is provided with a device for rewinding this portion of the strap. A spiral spring stores energy from the rotation of the reel when the strap is drawn off, and when the strap is fed back the spiral spring causes the reel to rotate so as to rewind the strap. Because the strap is fed back towards the reel faster than the reel can rewind the strap, a loose strap portion accumulates between the reel and the strap tightening mechanism. A case stores the loosened portion between the reel and the strap tightening mechanism, and is provided with a resistor to tension the strap moving from the case to the reel. The rewinding speed of the reel can thus be controlled by the resistor, to allow the strap to be exactly and smoothly rewound.

18 Claims, 2 Drawing Sheets

AUTOMATIC PACKAGE STRAPPING MACHINE

BACKGROUND OF THE INVENTION

This invention relates to an automatic package strapping machine for tightening a thermoplastic strap looped around a package. More particularly, it relates to an automatic package strapping machine capable of rewinding onto a reel an excess part of a loosened thermoplastic strap formed by tightening of the strap.

Package strapping machines adapted to automatically strap a package with a thermoplastic strap drawn off a reel and weld the overlapping ends of the strap by heat and pressure are widely used because their efficiency improves capacity and saves manpower.

The structure of general automatic package strapping machines will now be described with reference to FIG. 1. A sliding plate 1 is horizontally slidably supported by a table 1*a* on which a package A to be strapped is loaded. Disposed just under the sliding plate 1 are a first clamp 2, a pressing device 3, and a second clamp 4, arranged so that they can move up and down freely by means of a group of cams 6 secured to a cam shaft 5 driven by a motor $M_1$. Provided between the first clamp 2 and the pressing device 3 is a cutting blade 3*a* adapted to cut a thermoplastic strap B, and provided between the sliding plate 1 and the pressing device 3 is a heater (not shown) that can move back and forth therebetween.

The thermoplastic strap B is drawn off of a reel 7 by a pair of upper and lower rolls 8, 9, adapted to feed forward and tighten the strap, and then fed through a strap guide 10 and a guiding groove 11 of the first clamp 2. The strap is then introduced into an arch 12 standing upright on the table 1*a*, and looped around the package A. A leading end of the strap is then fed beneath the sliding plate 1. A motor $M_2$ driving rolls 8, 9 stops forward feeding of the strap B when the leading end of the strap B presses a switch (not shown).

The upper roll 8 is forwardly and backwardly rotated by the motor $M_2$, while the lower roll 9 is pressed firmly against the upper roll 8 by a spring 13, so that their nipping force helps the strap to move. The lower roll 9 is also designed to increase the nipping force with the upper roll 8 when the strap is required to be tightened. A roller 15 and a spring 16 are cammed by a cam 14 secured to the cam shaft 5 to further press the lower roll 9 against upper roll 8. On account of the nipping force increase, the strap looped around the package A can be fastened without causing slip between the rolls 8, 9.

When the strap looped around the package is tightened by the rolls 8, 9, it becomes loosened in an area between the rolls 8, 9 and the reel 7, which tends to cause entangling of the strap. One preferable and seemingly successful means to solve the problem has been the employment of a spiral spring. That is, it is seemingly possible to rewind onto the reel 7 an excess part of the strap loosened between the rolls 8, 9 and the reel 7 by the use of a spiral spring whose inner end is fixed to a reel shaft, enough power for rewinding the strap being given to the spiral spring when the strap is drawn off the reel. In order to rewind the loosened strap onto the reel, it is necessary for the spiral spring to have as much power as when having been wound up by the reeling off of the strap. Actually, however, the power of the spiral ring is a little too weak to rewind the comparatively heavy strap. As a result, the rewinding cannot catch up with the loosening of the strap, causing the strap to loosen between the rolls 8, 9 and the reel 7 so much that the strap tends to fall off of the reel 7, thus impeding smooth rewinding of the strap.

OBJECTS OF THE INVENTION

It is a primary object of this invention to provide an automatic package strapping machine capable of rewinding an excess part of a loosened strap onto a reel at the time the strap is tightened by a pair of rolls. It is a secondary object of this invention to provide an automatic package strapping machine capable of rewinding an excess part of a loosened strap with a very simple structure. The above and other objects and features of this invention will appear more fully hereinafter from a consideration taken in connection with the accompanying drawings.

DETAILED DESCRIPTION OF THE INVENTION

Figure 1:
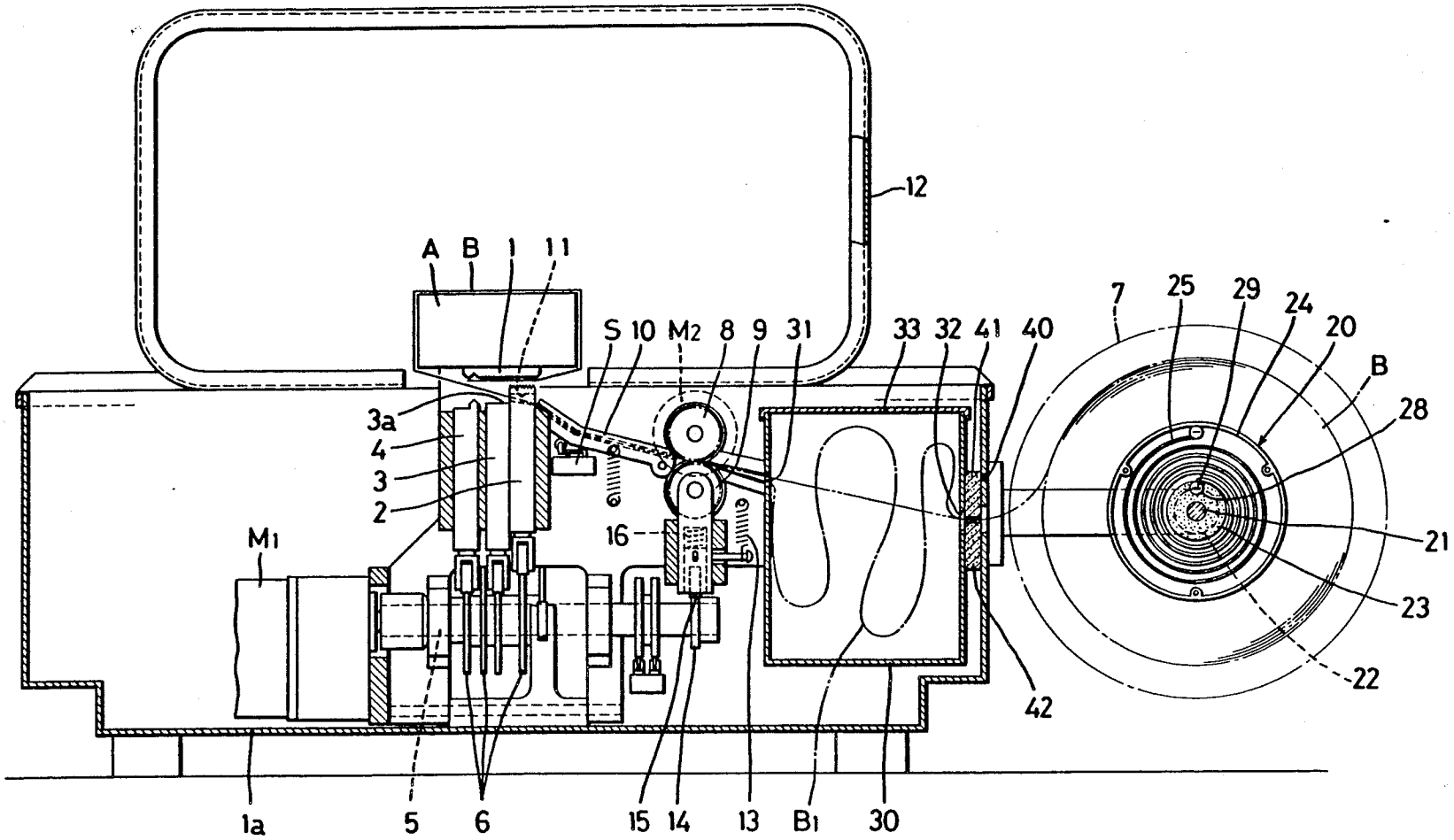
FIG. 1 is an elevational cross-sectional view of an automatic package strapping machine embodying this invention.

The structure of an automatic package strapping machine of this invention is basically the same as that of the machine described above with reference to FIG. 1. Additionally, a rewinding device 20 is provided for the reel 7, a case 30 stores a portion of the thermoplastic strap, and a resistor 40 is provided between the rolls 8, 9 and the reel 7.

Figure 2:
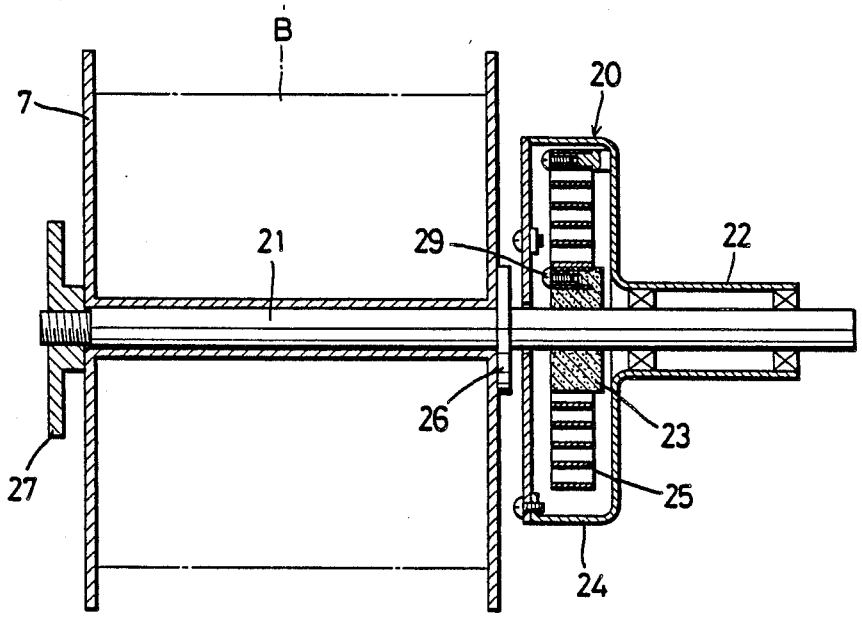
FIG. 2 is a cross-sectional view of a reel used for the above package strapping machine.

As shown in FIGS. 1 and 2, the rewinding device 20 that works in association with the reel 7 is constructed of a shaft 21 rotatably supported in a horizontal position by a bearing 22 fixed to the table 1*a*. The reel 7 is detachably fixed to the shaft 21, a slip roller 23 is fitted onto the shaft 21, and a spiral spring 25 is connected between the slip roller 23 and a cover 24. A stopper 26 is secured to the outside of the shaft 21, and a screw 27 is detachably fixed to an end of the shaft 21, so that the reel 7 is held on the shaft 21 by the stopper 26 and the screw 27.

The slip roller 23 is made out of an elastic material such as rubber or synthetic resin and is elastically fitted on the shaft 21. The inner end of the spiral spring 25 is inserted in a groove 28 on the outside of the slip roller 23 and secured with a pin 29, while the outer end of the spiral spring 25 is fixed to the cover 24. Cover 24 covers the bearing 22 as well. The spiral spring 25 is wound by the rotation of the reel when the strap is drawn off the reel 7 to store elastic power. The stored elastic power serves to rotate the shaft 21 in the reverse direction so that the strap can be rewound onto the reel when loosened between the rolls 8, 9 and the reel 7.

The slip roller 23 is designed so as to give the shaft 21 a certain degree of frictional resistance. It rotates in association with the shaft 21 without slipping on the shaft 21, and thus winds the spiral spring 25 when the strap is reeled off. However, it slips on the shaft 21 when the spiral spring 25 is fully wound. The frictional resistance is set with the torque of the motor $M_2$ and the strength of the spring 13 taken into account. The strength of the spring 13, which serves to nip the strap between the rolls 8, 9, is designed to be stronger than the elastic power of the spiral spring 25.

The case 30 for storing the strap B has a box shape and is placed inside the table 1*a*. An inlet 32 and an outlet 31 for the strap are provided on the sides of the case 30 such that the outlet 31 is adjacent the rolls 8, 9, and the inlet is adjacent the reel 7. The top of the case 30 forms a lid 33, which can be opened or closed at will.

In a first example, a resistor 40 is made out of a pair of elastic members, one member 41 disposed on the upper side and the other member 42 disposed on the lower side of the inlet 32, each of which is fixed transverse to the lengthwise direction of the strap. The strap being rewound onto the reel 7 is thus given a certain degree of tension by the frictional resistance of the members, and guided to prevent its falling off of the reel 7. The frictional resistance given to the strap by the resistor 40 is designed to be weaker than the rewinding power of the spiral spring 25 on the reel 7.

Figure 3:
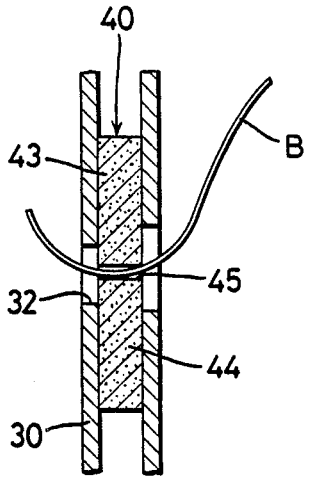
FIG. 3 is a cross-sectional view of a resistor adapted to give a thermoplastic strap a proper degree of tension when the strap is allowed to pass therethrough.

In a second example, the resistor 40 is a pair of hard members 43, 44, made out of metal for example. They are disposed outside the inlet 32 and fixed transverse to the lengthwise direction of the strap, as shown in FIG. 3. When the strap is allowed to pass through a narrow gap 45 when being rewound onto the reel 7, the strap is kept in contact with the upper member 43 and given a certain degree of frictional resistance.

Figure 4:
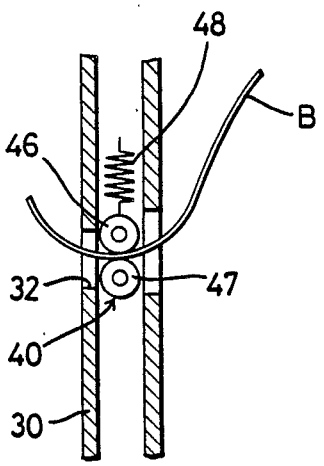
FIG. 4 is a cross-sectional view of another resistor used for the same purpose as the above.

In a third example, the resistor 40 is made out of a pair of rollers 46, 47. They are disposed outside the inlet 32, as shown in FIG. 4. They are pressed against each other by a spring 48 so that they nip the strap and give it a certain degree of resistance.

The structure of the automatic package strapping machine has been described. In order that this invention may be more clearly understood, reference will now be made to its operation.

The strap B is drawn off of the reel 7 and forwarded into the arch 12 on the table 1*a* by means of the strap forwarding and tightening rolls 8, 9 driven by the motor $M_2$. During the reeling off of the strap B, the shaft 21 rotates so as to wind the spiral spring 25. When the spiral spring 25 is completely wound, the shaft 21 and the slip roller 23 slip against each other. The strap B is forwarded by the pull of the rolls 8, 9 until the leading end of the strap presses the switch. Under this condition the strap B is tensed between the rolls 8, 9 and the reel 7, as shown by a two-dotted line in FIG. 1, because the power of the spring 25 to wind the strap is imparted to the reel 7.

When a package A is placed on the table 1*a*, the motor $M_1$ is energized. When the first clamp 2 ascends and clamps the leading end of the strap B in cooperation with the sliding plate 1, the motor $M_1$ stops. The motor $M_2$ starts and reversely rotates the strap forwarding and tightening rolls 8, 9 so as to pull back and tighten the strap B, which detaches from the arch 12 and loops around the package A. When the strap guide 10 and a switch S detect that the strap around the package is fully tightened, the motor $M_2$ stops. The motor $M_1$ starts again, which lifts the second clamp 4 and the pressing device 3, cuts the strap beneath the leading end thereof, and moves the heater between the overlapping ends to weld them together with heat and pressure.

When tightening the strap around the package A, the strap forwarding and tightening rolls 8, 9 rotate back considerably faster than when forwarding the strap. The backward speed of the strap is thus greater than the rewinding speed of the reel with the result that the strap becomes loosened between the rolls 8, 9 and the reel 7, as shown by a single dot chain line $B_1$ in FIG. 1. The loosened strap is stored in the case 30 for a while. Accordingly, the reel 7 has to continue to rewind the strap even after the rolls 8, 9 have finished tightening the strap. Slow as it is, the reel 7 eventually rewinds the loosened strap B with the aid of the resistor 40 and tenses the strap in the case 30, as shown by the two-dot chain line in FIG. 1. Because the strap B being rewound on the reel 7 is given a certain degree of tension by the resistor 40, it is always smoothly rewound on the reel 7.

When the heater finishes welding the ends of the strap, the first clamp 2, the pressing device 3, and the second clamp 4 are lowered. The sliding plate 1 is withdrawn from between the strap B and the package A and the motor $M_2$ forwardly rotates the rolls 8, 9 in order to advance the strap into the arch 12. In this way, the machine returns to the initial standby condition, preparing itself for the next strapping. When the strap is reeled off, it is pulled forward by a stronger force than the counterforce it receives from the resistor 40 and the spiral spring 25.

I claim:

1. A package strapping machine, comprising:
   - a machine frame;
   - a reel for holding a length of strap disposed adjacent said machine frame;
   - support means on said machine frame for supporting a package to be strapped;
   - means for feeding said strap from said reel to a position around said package and for tightening said strap around said package;
   - means for holding a leading end of said strap when said means for feeding and tightening tightens said strap around said package;
   - means for storing an excess strap portion generated when said means for feeding and tightening tightens said strap around said package, said means for storing disposed between said means for feeding and tightening and said reel;
   - means for rewinding said excess strap portion onto said reel; and
   - resistor means disposed between said means for storing and said reel for providing a tension in a portion of said strap adjacent said reel when said strap is rewound by said means for rewinding;
   - whereby said means for storing and said resistor means enable said strap to be smoothly rewound onto said reel.

2. The package strapping machine of claim 1, wherein said means for feeding and tightening tightens said strap around said package at a faster rate than said means for rewinding rewinds said strap, thereby generating said excess portion of said strap.

3. The package strapping machine of claim 1, wherein said reel is mounted on an exterior wall of said machine frame.

4. The package strapping machine of claim 1, wherein said means for storing is disposed adjacent an interior wall of said machine frame.

5. The package strapping machine of claim 1, wherein said means for storing comprises a casing having a first strap receiving aperture adjacent said means for feeding and tightening and a second strap receiving aperture adjacent said reel.

6. The package strapping machine of claim 5, wherein a third strap receiving aperture is formed in an interior wall of said machine frame and said resistor means is disposed between said second aperture and said third aperture.

7. The package strapping machine of claim 6, wherein said resistor means comprises a friction member frictionally engaging said strap.

8. The package strapping machine of claim 7, wherein said resistor means further comprises an additional member, said friction member and said additional member receiving said strap therebetween.

9. The package strapping machine of claim 7, wherein said friction member is elastic.

10. The package strapping machine of claim 7, wherein said friction member is rigid.

11. The package strapping machine of claim 6, wherein said resistor means comprises a first roll biased against a second roll to nip said strap therebetween.

12. The package strapping machine of claim 1, wherein said resistor means comprises a friction member frictionally engaging said strap.

13. The package strapping machine of claim 12, wherein said resistor means further comprises an additional member, said friction member and said additional member receiving said strap therebetween.

14. The package strapping machine of claim 12, wherein said friction member is rigid.

15. The package strapping machine of claim 12, wherein said friction member is elastic.

16. The package strapping machine of claim 1, wherein said resistor means comprises a first roll biased against a second roll to nip said strap therebetween.

17. The package strapping machine of claim 1, wherein said means for feeding and tightening said strap comprises a pair of rolls nipping said strap therebetween and a motor for reversibly driving said roll.

18. A package strapping machine, comprising:

a machine frame;

a strap reel adjacent said machine frame;

means for rewinding an excess strap portion onto said strap reel at a rewinding rate;

means for feeding a strap from said strap reel about a package, and for tightening said strap about said package at a tightening rate, said tightening rate being faster than said rewinding rate to thereby generate said excess strap portion between said means for feeding and tightening and said strap reel;

means for storing said excess strap portion between said means for feeding and tightening and said strap reel; and resistor means between said means for storing and said reel for tensioning a portion of said strap as it is rewound;

whereby said means for storing and said resistor means enable said excess strap portion to be smoothly rewound onto said strap reel.

* * * * *